US011047347B2

(12) United States Patent
Sugahara

(10) Patent No.: US 11,047,347 B2
(45) Date of Patent: Jun. 29, 2021

(54) EXHAUST GAS RECIRCULATING DEVICE

(71) Applicant: Isuzu Motors Limited, Tokyo (JP)

(72) Inventor: Takashi Sugahara, Yokohama (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 16/624,300

(22) PCT Filed: Jun. 15, 2018

(86) PCT No.: PCT/JP2018/022918
§ 371 (c)(1),
(2) Date: Dec. 19, 2019

(87) PCT Pub. No.: WO2018/235737
PCT Pub. Date: Dec. 27, 2018

(65) Prior Publication Data

US 2020/0124005 A1 Apr. 23, 2020

(30) Foreign Application Priority Data

Jun. 22, 2017 (JP) ..... JP2017-122360

(51) Int. Cl.
*F02M 26/05* (2016.01)
*F02M 26/35* (2016.01)
(Continued)

(52) U.S. Cl.
CPC ..... *F02M 26/05* (2016.02); *F02M 26/35* (2016.02); *F02B 37/00* (2013.01); *F02D 41/0007* (2013.01);
(Continued)

(58) Field of Classification Search
CPC ..... F02M 26/05; F02M 26/35; F02M 26/15; F02M 26/22; F02B 37/00; F02D 41/0007; F02D 41/0077; F02D 2200/0406
See application file for complete search history.

(56) References Cited

U.S. PATENT DOCUMENTS 5,855,195 A * 1/1999 Oikawa ..... F02D 41/221 123/339.25
2010/0256894 A1* 10/2010 Yasui ..... F02D 41/0235 701/108
(Continued)

FOREIGN PATENT DOCUMENTS

CN 105604747 5/2016
CN 106948976 7/2017
(Continued)

OTHER PUBLICATIONS

International Search Report and the Written Opinion dated Aug. 28, 2018 From the International Searching Authority Re. Application No. PCT/JP2018/022918 and Its Translation of Search Report Into English. (8 Pages).
(Continued)

*Primary Examiner* — Joseph J Dallo

(57) ABSTRACT

Provided is an exhaust gas recirculating device which can curb strange noises caused by the opening and closing of a reed valve. An EGR duct (14) has a greater volume than the prior art in order to curb resonance within the EGR passage (Eg) of the opening and closing sounds generated by the reed valve (13). Specifically, the EGR duct (14) has resonant frequency characteristics which differ from the resonance frequency of the reed valve (13), and has a shape such that strange noises generated by the reed valve (13) do not resonate within the EGR duct (14).

3 Claims, 5 Drawing Sheets

(51) Int. Cl.

| | |
|---|---|
| *F02M 26/15* | (2016.01) |
| *F02M 26/22* | (2016.01) |
| *F02B 37/00* | (2006.01) |
| *F02D 41/00* | (2006.01) |

(52) U.S. Cl.
CPC .. *F02D 41/0077* (2013.01); *F02D 2200/0406* (2013.01); *F02M 26/15* (2016.02); *F02M 26/22* (2016.02)

(56) References Cited

U.S. PATENT DOCUMENTS

| | | | | |
|---|---|---|---|---|
| 2010/0300088 | A1* | 12/2010 | Joergl | F02B 39/16 60/602 |
| 2011/0017179 | A1* | 1/2011 | Ichihara | F02M 26/47 123/568.21 |
| 2011/0041495 | A1* | 2/2011 | Yager | F02M 26/05 60/605.2 |
| 2012/0124992 | A1* | 5/2012 | Fiveland | F02M 26/00 60/599 |
| 2012/0137675 | A1* | 6/2012 | Ito | F01N 13/009 60/602 |
| 2014/0360179 | A1* | 12/2014 | Doering | F02B 37/18 60/602 |

FOREIGN PATENT DOCUMENTS

| | | |
|---|---|---|
| JP | 01-177446 | 7/1989 |
| JP | 2000-249004 | 9/2000 |
| JP | 20002-49004 | 9/2000 |
| JP | 2001-132557 | 5/2001 |
| JP | 2001-132557 | 12/2001 |
| JP | 2002-013442 | 1/2002 |
| JP | 2003-269263 | 9/2003 |
| JP | 2003-269264 | 9/2003 |
| JP | 2009-228645 | 10/2009 |
| JP | 2016-029296 | 3/2016 |
| JP | 2016-044584 | 4/2016 |
| JP | 2017-096100 | 6/2017 |
| JP | 20020-13442 | 2/2019 |
| WO | WO 2018/235737 | 12/2018 |

OTHER PUBLICATIONS

Notification of Office Action and Search Report dated Jan. 28, 2021 From the State Intellectual Property Office of the People's Republic of China Re. Application No. 201880039178.3. (6 Pages).

* cited by examiner

EXHAUST GAS RECIRCULATING DEVICE

TECHNICAL FIELD

The present disclosure relates to an exhaust gas recirculation device including a reed valve.

BACKGROUND ART

In order to reduce NOx in exhaust gas from an engine, an exhaust gas recirculation (hereinafter also referred to as "EGR") device that recirculates the exhaust gas to the engine is widely used.

The EGR device can adjust the mass flow rate of the returning EGR gas by controlling an EGR valve provided in an EGR passage. In some of the engine specifications, the differential pressure between the inlet and outlet of the EGR valve is small and may become negative depending on the driving condition. In such an engine, a reed valve (check valve) is provided at a connection position between the EGR passage and an intake passage of the engine to prevent the backflow of the EGR gas, and at the same time, the EGR gas is pumped out by using periodic differential pressure change caused by pulsation of intake/exhaust stroke of the cylinder. As such a reed valve, mainly a reed-type one-way valve is used (see PTLs 1 and 2).

CITATION LIST

Patent Literature

PTL1
Japanese Patent Application Laid-Open No. 2000-249004
PTL2
Japanese Patent Application Laid-Open No. 2001-132557

SUMMARY OF INVENTION

Technical Problem

In an EGR device using the above described reed valve, the opening/closing sound of the reed valve resonates in the EGR passage, so that an unusual noise (like shuffling sound) may be generated. If this sound is heard from the outside, the product quality may be deteriorated.

An object of the present disclosure is to provide an exhaust gas recirculation device capable of suppressing an unusual noise caused by a reed valve.

Solution to Problem

An aspect of the present disclosure is an exhaust gas recirculation device for returning a part of exhaust gas from an engine to an intake side of the engine through an EGR passage, and the exhaust gas recirculation device includes:

a reed valve provided at a connection position between the EGR passage and an intake passage of the engine;

an EGR valve provided at the EGR passage; and an EGR duct that forms a passage connecting the EGR valve and an EGR cooler, the EGR duct being a portion of the EGR passage, in which the EGR duct is formed so as to suppress resonance of opening/closing sound generated by the reed valve, the resonance being inside the EGR passage.

Advantageous Effects of Invention

The present disclosure can suppress an unusual noise caused by a reed valve since the EGR duct is formed so as to suppress resonance, inside an EGR passage, of opening/closing sound generated by the reed valve.

DESCRIPTION OF EMBODIMENTS

Hereinafter, an embodiment of the present disclosure will be described with reference to the drawings.

Although an in-line four-cylinder diesel engine will be described as an example in the embodiment, the present invention is not limited to a diesel engine but can also be applied to a gasoline engine. In addition, the number of cylinders in the engine and the arrangement of the cylinders are not limited, either. For the drawings, the dimensions are adjusted so as to make configurations easily understandable, and the ratio of the plate thickness, width, length or the like of each member or part does not necessarily match that of actually manufactured member or part.

Figure 1:
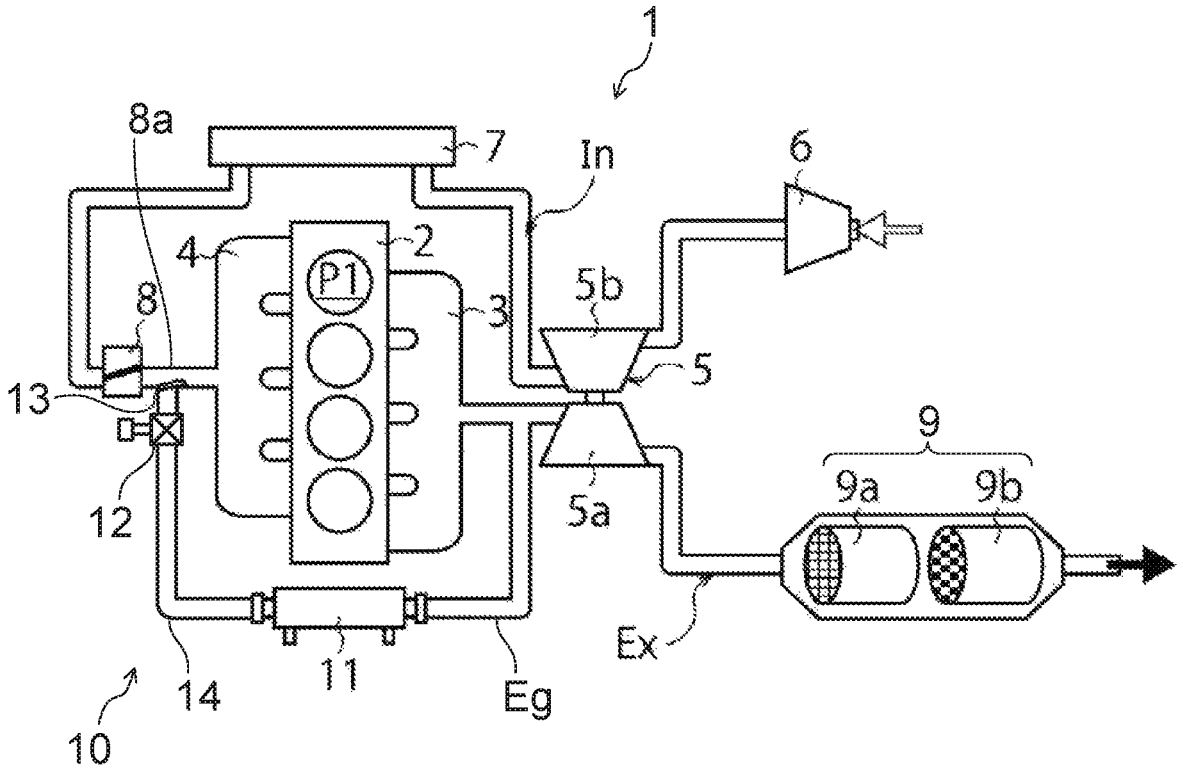
FIG. 1 schematically illustrates the overall configuration of an embodiment.

As illustrated in FIG. 1, engine (internal combustion engine) 1 is provided with engine body 2, exhaust passage Ex, intake passage In, and EGR (exhaust gas recirculation) passage Eg. Engine 1 is further provided with exhaust manifold 3, inlet manifold 4, turbocharger 5 including variable turbine 5*a* and compressor 5*b*, air cleaner 6, intercooler 7, intake throttle 8, intake duct 8*a*, after-treatment device 9 including DOC (diesel oxidation catalyst) 9*a* and DPF (collecting device) 9*b*, and EGR device 10.

EGR device 10 is provided with EGR cooler 11, EGR valve 12, and reed valve (check valve) 13. EGR cooler 11 and EGR valve 12 are connected by EGR duct 14.

Engine 1 is a so-called high-pressure EGR system in which EGR gas is returned from the exhaust gas upstream side of turbocharger 5. Therefore, the differential pressure between the inlet and outlet of EGR valve 12 becomes small, and even becomes negative depending on the driving condition. In the present embodiment, reed valve 13 is provided at a connection position between EGR passage Eg and intake passage In of engine 1 to prevent the backflow of the EGR gas, and at the same time, the EGR gas is pumped out into intake passage In by using periodic differential pressure change caused by pulsation of intake/exhaust stroke of the cylinder.

Figure 2:
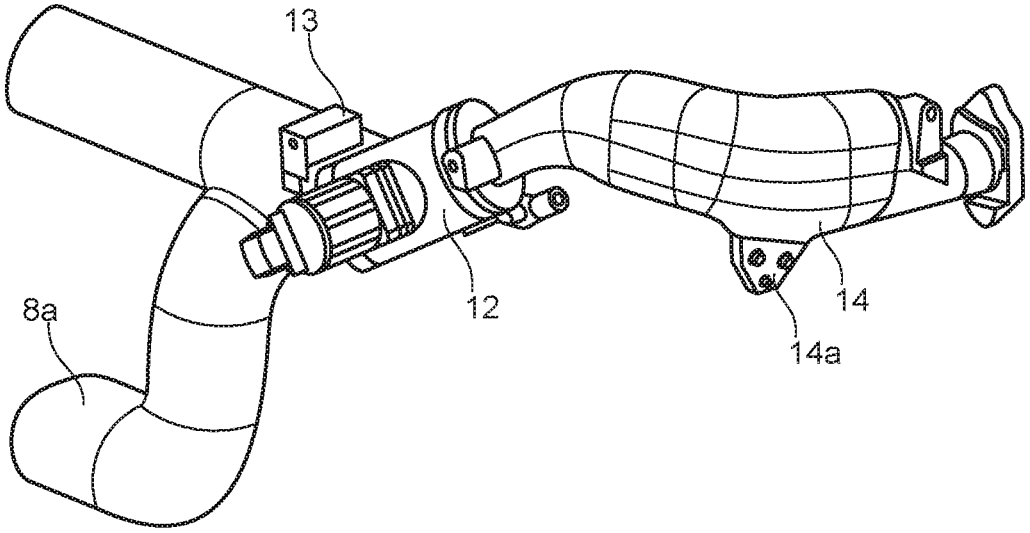
FIG. 2 is a perspective view illustrating a state of an EGR duct, an EGR valve, and an intake duct according to the embodiment.
Figure 3:
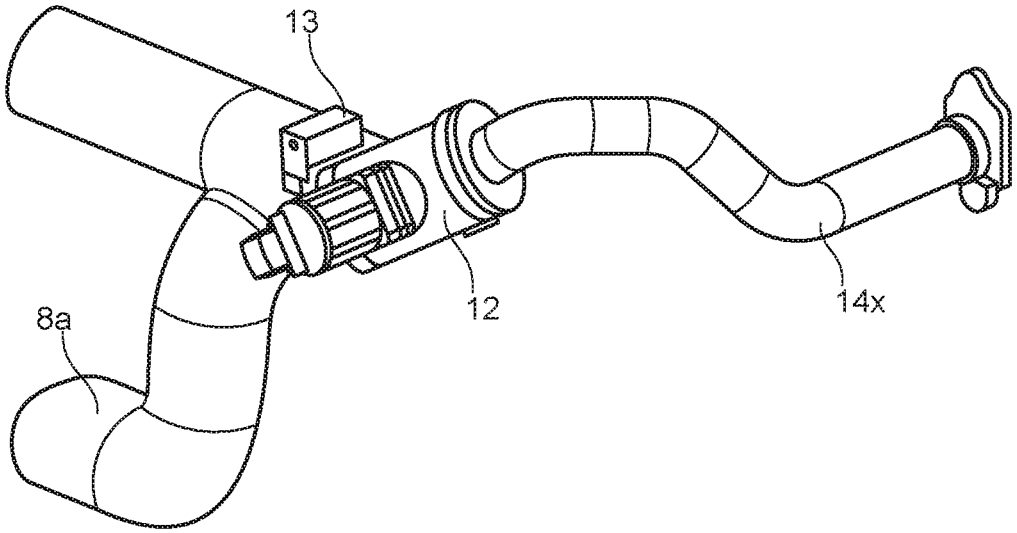
FIG. 3 is a perspective view illustrating a state of an EGR duct, an EGR valve, and an intake duct of a conventional art.

FIG. 2 is a perspective view illustrating a state of EGR duct 14, EGR valve 12, and intake duct 8*a* of the embodiment. FIG. 3 meanwhile is a perspective view illustrating a state of EGR duct 14*x*, EGR valve 12, and intake duct 8*a* of a conventional art as a comparative example.

As apparent from a comparison between FIG. 2 and FIG. 3, EGR duct 14 of the present embodiment has a larger volume than conventional EGR duct 14*x*. With this configuration, EGR duct 14 of the present embodiment has a function of a silencer that silences the shuffling sound generated when reed valve 13 opens and closes.

In practice, EGR duct 14 is formed so as to suppress resonance, within EGR passage Eg, of opening/closing sound generated by reed valve 13. That is, the resonance is suppressed by making the volume of the hollow part of EGR duct 14 larger than that of conventional EGR duct 14*x* in the present embodiment.

Figure 4:
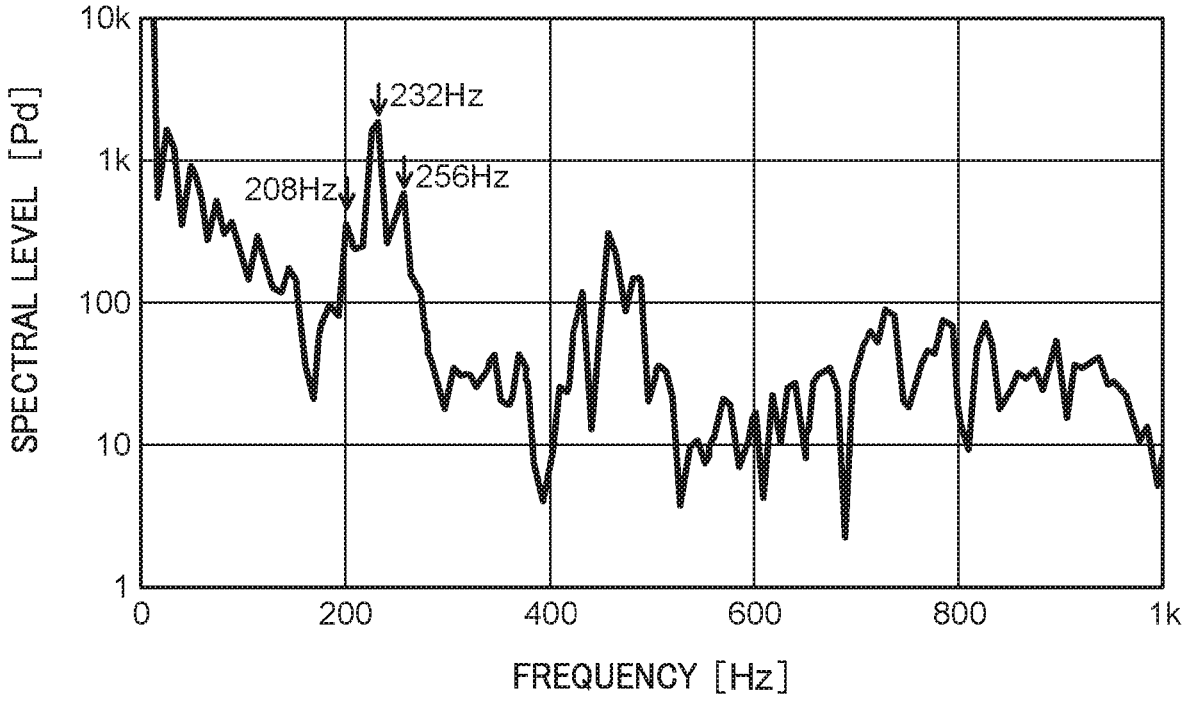
FIG. 4 shows frequency characteristics observed on the inlet side of the EGR valve (i.e., on the EGR duct side)

FIG. 4 shows frequency characteristics of opening/closing sound of reed valve 13 observed on the inlet side of EGR valve 12 (i.e., on the EGR duct 14 side). FIG. 4 reveals that resonance frequencies of the opening/closing sound generated by reed valve 13 exist in the range of 208 to 256 Hz. In the present embodiment, the shape of EGR duct 14 such as a volume is determined so that resonance in EGR duct 14 does not occur at those resonance frequencies.

In the present embodiment, EGR duct 14 has a shape such that it does not resonate at a frequency of 200 to 260 Hz. Specifically, the resonant frequency (i.e., resonance frequency of EGR duct 14) is adjusted to be lower than 200 Hz by increasing the volume of EGR duct 14 compared to the conventional duct. Such a configuration can prevent the opening/closing sound of reed valve 13 from resonating in EGR duct 14.

Further, EGR duct 14 is formed of a casting in the present embodiment. EGR duct 14 formed of a casting can further suppress leaking of an unusual noise generated by opening/closing of reed valve 13 to the outside via EGR duct 14. That is, leaking of an unusual noise to the outside can be suppressed by suppressing the loudness of the unusual noise itself in EGR passage Eg with the use of EGR duct 14 having a shape that suppresses the resonance of the opening/closing sound generated by reed valve 13 within the EGR passage, as well as by forming EGR duct 14 from a casting. The unusual noise heard from outside thus can be further suppressed.

Figure 5:
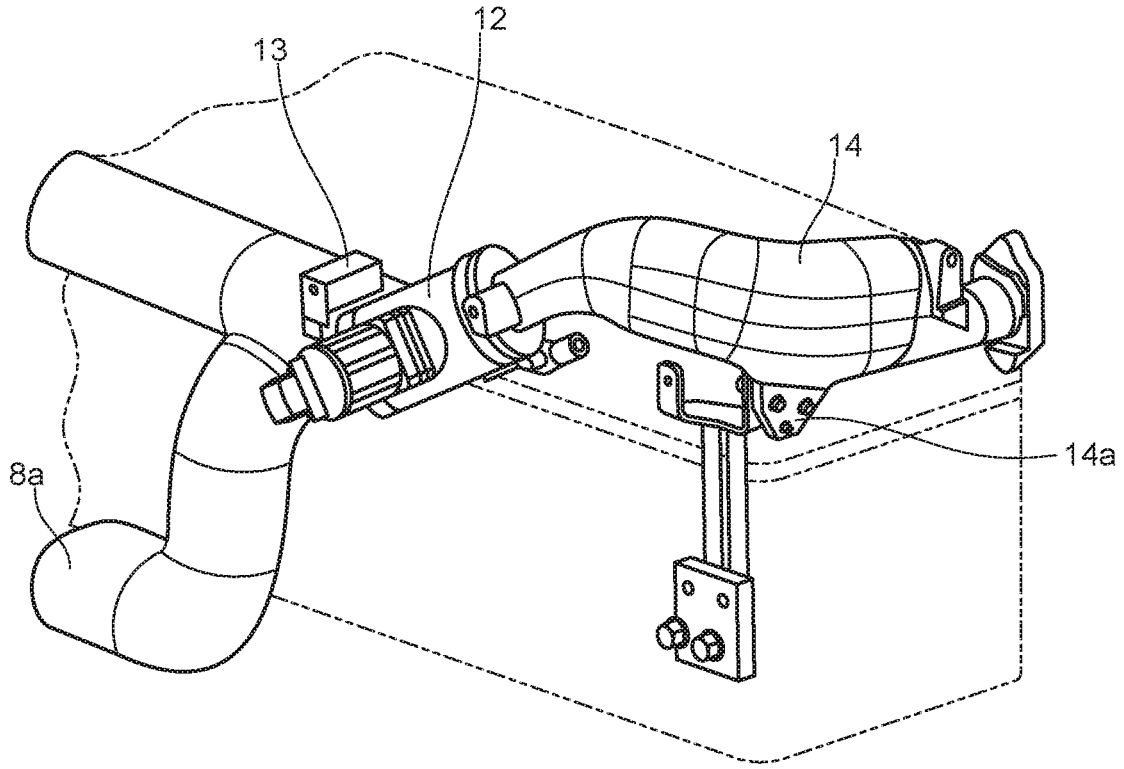
FIG. 5 is a perspective view illustrating a state where the EGR duct is fixed according to the embodiment.

Forming EGR duct 14 from a casting increases its weight, and thus fixing portion 14*a* for fixing EGR duct 14 to the outside is formed on the outer surface of EGR duct 14 as illustrated in FIGS. 2 and 5 in the present embodiment. EGR duct 14 is then fixed to, for example, an engine block indicated by a dashed-dotted line via fixing portion 14*a* as illustrated in FIG. 5.

As described above, the present embodiment can realize exhaust gas recirculation device 10 capable of suppressing an unusual noise caused by reed valve 13 by employing the shape of EGR duct 14 that suppresses the resonance, within EGR passage Eg, of the opening/closing sound generated by reed valve 13.

The embodiment disclosed herein is a mere exemplification for practicing the present invention, and should not be construed as limiting the technical scope of the present invention in any way. Specifically, various modifications are possible without departing from the spirit or main features of the present invention.

In the embodiment disclosed herein, resonance frequencies generated by the opening/closing of reed valve 13 exist in the range of 208 to 256 Hz as shown in FIG. 4, and thus the resonant frequency of EGR duct 14 (i.e., resonance frequency of EGR duct 14) is adjusted to be lower than 200 Hz; however, the resonant frequency of EGR duct 14 (i.e., resonance frequency of EGR duct 14) can be set in accordance with resonance frequencies generated by the opening/closing of reed valve 13. That is, EGR duct 14 can be formed to have a shape such that EGR duct 14 does not resonate (sympathize) at the resonance frequencies generated by the opening/closing of reed valve 13.

This application is entitled to and claims the benefit of Japanese Patent Application No. 2017-122360 filed on Jun. 22, 2017, the disclosure of which including the specification, drawings and abstract is incorporated herein by reference in its entirety.

INDUSTRIAL APPLICABILITY

The exhaust gas recirculation device of the present disclosure is suitable as an exhaust gas recirculation device including a reed valve.

REFERENCE SIGNS LIST

1 Engine
2 Engine body
10 EGR (exhaust gas recirculation) device
11 EGR cooler
12 EGR valve
13 Reed valve
14, 14*x* EGR duct
14*a* Fixing portion
Eg EGR (exhaust gas recirculation) passage
Ex exhaust passage
In Intake passage

What is claimed is:

1. An exhaust gas recirculation device for returning a part of exhaust gas from an engine to an intake side of the engine through an EGR passage, the exhaust gas recirculation device comprising:

a reed valve provided at a connection position between the EGR passage and an intake passage of the engine;

an EGR valve provided at the EGR passage; and an EGR duct that forms a passage connecting the EGR valve and an EGR cooler with each other, the EGR duct being a portion of the EGR passage, wherein the EGR duct has characteristics of resonant frequency of 200 Hz or lower, and suppresses resonance of opening/closing sound generated by the reed valve, the resonance being inside the EGR passage.

2. The exhaust gas recirculation device according to claim 1, wherein the EGR duct is formed of a casting.

3. The exhaust gas recirculation device according to claim 2, wherein an outer surface of the EGR duct is provided with a fixing portion for fixing the EGR duct to an outside.

* * * * *